US007836621B2

(12) United States Patent
Mueller et al.

(10) Patent No.: US 7,836,621 B2
(45) Date of Patent: Nov. 23, 2010

(54) LABEL HOLDER FOR A MERCHANDISE DISPLAY SHELF

(75) Inventors: Paul A. Mueller, Wadsworth, OH (US); Stephen D. Wamsley, Lakewood, OH (US)

(73) Assignee: Fasteners for Retail, Inc., Cleveland, OH (US)

( * ) Notice: Subject to any disclaimer, the term of this patent is extended or adjusted under 35 U.S.C. 154(b) by 434 days.

(21) Appl. No.: 11/918,842

(22) PCT Filed: Apr. 21, 2006

(86) PCT No.: PCT/US2006/015068

§ 371 (c)(1),
(2), (4) Date: Oct. 19, 2007

(87) PCT Pub. No.: WO2006/116068

PCT Pub. Date: Nov. 2, 2006

(65) Prior Publication Data

US 2009/0056190 A1 Mar. 5, 2009

Related U.S. Application Data

(60) Provisional application No. 60/673,510, filed on Apr. 21, 2005.

(51) Int. Cl.
*G09F 3/18* (2006.01)
*A47B 96/06* (2006.01)

(52) U.S. Cl. ..... 40/661.03; 40/642.02; 40/649; 248/231.81; 248/220.22

(58) Field of Classification Search ..... 40/661.03, 40/642.02, 649; 248/231.81, 220.22
See application file for complete search history.

(56) References Cited

U.S. PATENT DOCUMENTS

| | | | | |
|---|---|---|---|---|
| 2,679,846 | A | 6/1954 | Addison | |
| 3,320,690 | A | 5/1967 | Forsburg | |
| 4,295,288 | A | 10/1981 | Westberg | |
| 5,419,066 | A | 5/1995 | Harnois et al. | |
| 5,488,793 | A * | 2/1996 | Gebka et al. | 40/661.03 |
| 5,515,632 | A | 5/1996 | Gebka et al. | |
| 5,899,011 | A | 5/1999 | Brinkman | |
| 6,105,295 | A | 8/2000 | Brinkman et al. | |
| 6,226,910 | B1 | 5/2001 | Ireland | |
| 6,470,613 | B1 | 10/2002 | Wildrick | |
| 6,481,133 | B1 | 11/2002 | DeSena | |
| 6,523,291 | B2 | 2/2003 | Nagel | |
| 6,568,112 | B2 | 5/2003 | Lowry et al. | |
| 6,665,971 | B2 | 12/2003 | Lowry et al. | |
| 6,688,567 | B2 | 2/2004 | Fast et al. | |
| 6,971,201 | B2 * | 12/2005 | Brinkman et al. | 40/642.02 |
| 7,325,348 | B2 * | 2/2008 | Mueller et al. | 40/649 |
| 7,627,971 | B2 * | 12/2009 | Fast | 40/661.03 |
| 2005/0166437 | A1 | 8/2005 | Brinkman et al. | |
| 2006/0086027 | A1 | 4/2006 | Brinkman et al. | |

* cited by examiner

*Primary Examiner*—Lesley Morris
*Assistant Examiner*—Syed A Islam
(74) *Attorney, Agent, or Firm*—Fay Sharpe LLP

(57) ABSTRACT

A label holder, that can be selectively mounted to an associated merchandise display shelf/includes a front panel and a rear panel. A hinge connects the front panel to the rear panel, creating a pocket between the front panel and the rear panel for receiving an associated label. A retaining member projects rearwardly from the rear panel. A first lip extends rearwardly from the rear panel, in a manner spaced from the retaining member. The first lip engages an angled forward portion of the associated display shelf when the label holder is in an installed position.

25 Claims, 7 Drawing Sheets

LABEL HOLDER FOR A MERCHANDISE DISPLAY SHELF

A claim for domestic priority is made herein under 35 U.S.C. §119(e) to U.S. Provisional Application Ser. No. 60/673,510 filed on Apr. 21, 2005, the entire disclosure of which is incorporated herein by reference.

BACKGROUND

The present invention relates to devices used to retain and present labels on a merchandise display shelf. In particular, the present invention involves label holders that can be selectively attached to a shelf by clipping the holder around the forward end of the shelf.

Clip-on label holders are known in the art. The general principle by which label holders are attached to an associated merchandise display shelf involves clipping and engaging the label holder around the forward end of the display shelf. The clipping motion involves the deflection of an elastic yet resilient material. During installation, the material elastically deforms to allow the engagement of the shelf. Subsequently, the material relaxes and contacts the shelf in multiple locations. The degree and security of attachment depends on the amount of pressure exerted by the material of the label holder against the shelf.

Although label holders for display shelves are commonplace, they are still deficient with respect to the reliability of attachment. Prior art label holders that engage the forward end of a shelf can be inadvertently dislodged by a customer or employee while removing or stocking merchandise on the display shelf.

The present invention provides a new design that improves the reliability of attachment of the label holder to a display shelf and provides certain other benefits as well.

SUMMARY OF THE INVENTION

A label holder according to a first embodiment of the present invention is selectively mounted to an associated merchandise display shelf. The label holder comprises a front panel, a rear panel and a hinge connecting the front panel to the rear panel. A pocket is created between the front panel and the rear panel for receiving an associated label. A retaining member projects rearwardly from the rear panel. A first lip extends rearwardly from the rear panel in a manner spaced from the retaining member. The first lip engages an angled forward portion of the associated display shelf when the label holder is in an installed position.

According to another embodiment of the present invention, a label holder is provided for selectively mounting to an associated merchandise display shelf. In accordance with this embodiment of the present invention, the label holder comprises a front panel, a rear panel and a hinge connecting the front panel to the rear panel. A retaining member projects rearwardly from the rear panel for selectively engaging a ledge portion of the associated shelf. A lip projects rearwardly from the rear panel in a spaced manner from the retaining member. The rear panel assumes a substantially flat orientation when not mounted on the associated shelf. The lip engages an angled forward portion of the associated shelf when the label holder is in a mounted condition and the rear panel then assumes a forwardly canted orientation.

According to another embodiment of the present invention, a one piece label holder is provided for selectively mounting to an associated merchandise display shelf. The display shelf comprises a shelf portion attached to an angled forward portion and a ledge portion. The label holder comprises a front panel including an upper edge and a lower edge and a rear panel including an upper edge and a lower edge. A panel hinge connects the front panel to the rear panel, creating a cavity between the front panel and the rear panel for receiving an associated label. A retaining member projects rearwardly from the rear panel. The retaining member includes a lower support flange, an upper support flange and a hinge connecting the lower support flange to the upper support flange. A top wall is mounted to the upper edge of the rear panel. The top wall includes a portion protruding rearwardly from the rear panel.

BRIEF DESCRIPTION OF THE DRAWINGS

The invention may take form in certain structures and components, several embodiments of which will be described in detail in this specification and illustrated in the accompanying drawings. In the drawings.

DETAILED DESCRIPTION

Figure 1:
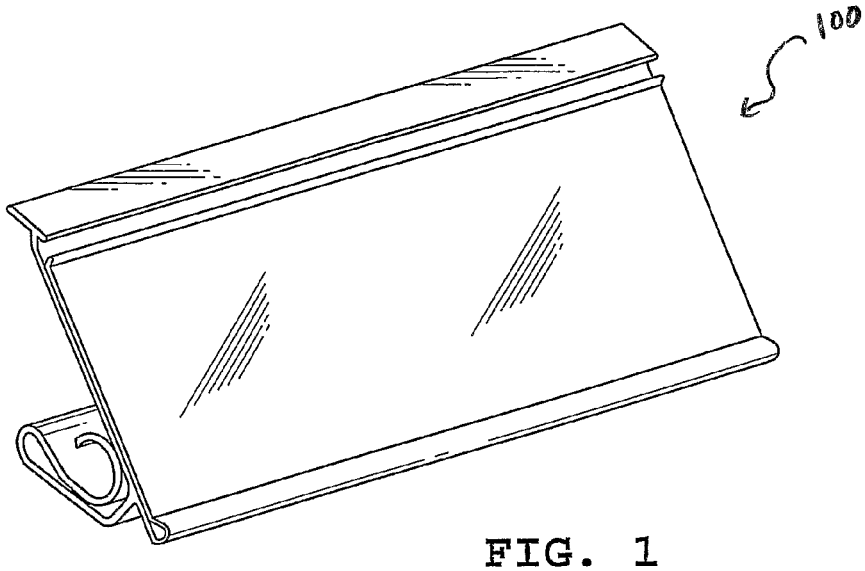
FIG. 1 is a perspective view of a first embodiment of a label holder according to the present invention.
Figure 2:
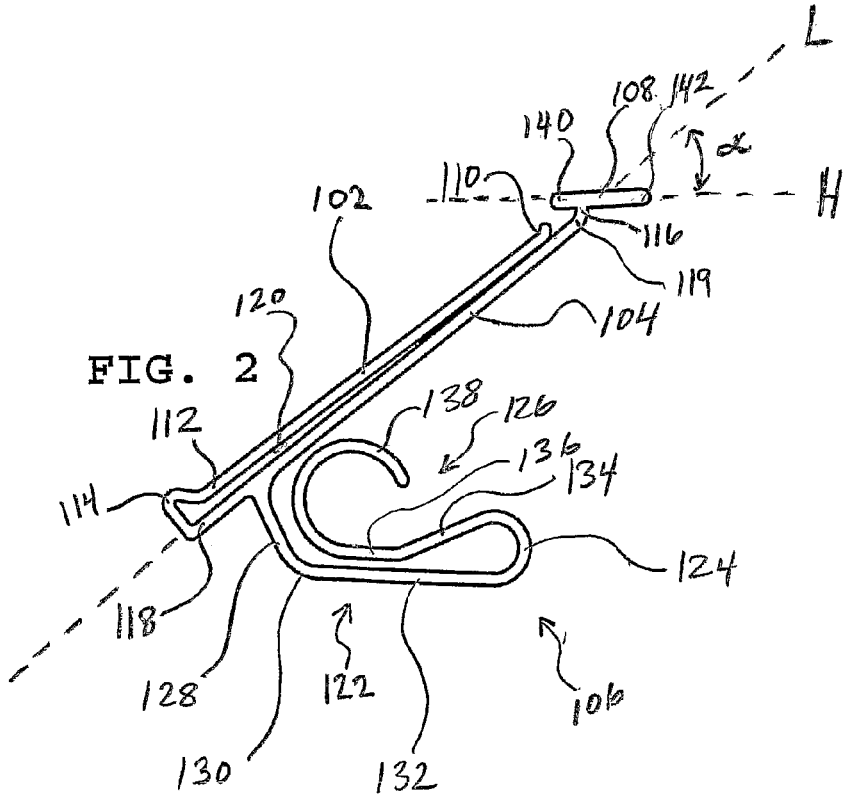
FIG. 2 is a side view of the label holder of FIG. 1.
Figure 3:
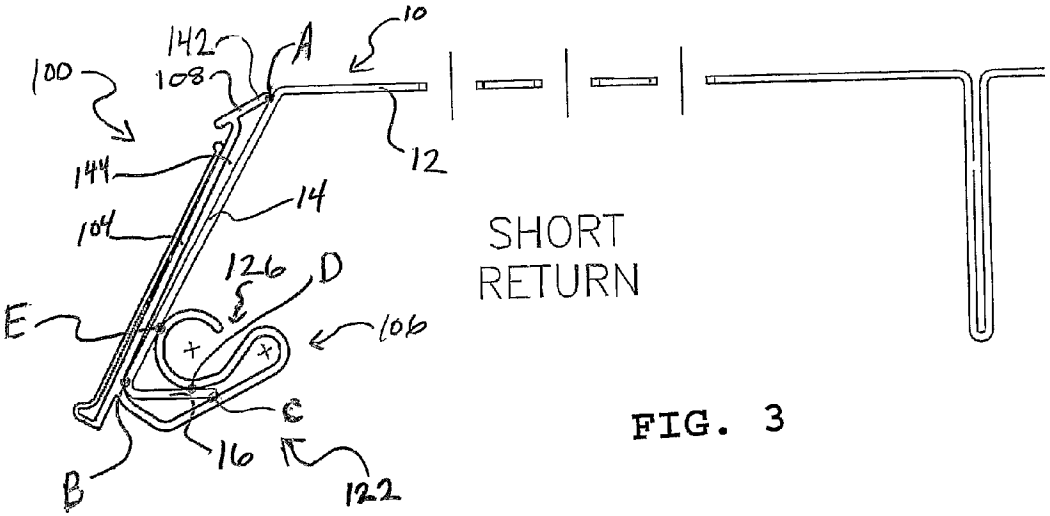
FIG. 3 is a side view of the label holder of FIG. 1 installed on a shelf with a short return (i.e. a shorter ledge portion of a shelf).

With reference to FIG. 1, a perspective view of a first embodiment of a label holder 100 is depicted. The label holder 100 is designed such that it can be easily attached to and removed from an associated merchandise display shelf 10 (FIG. 3). With reference now to FIG. 2, the label holder 100 is shown in a relaxed position or unmounted state and includes a pocket or a forward facing cavity 120 where a merchandise label may be easily inserted and securely retained therein. The label holder 100 can be formed as a one piece plastic design by extrusion or injection molding.

With continued reference to FIG. 2, the label holder 100 includes four primary components: a front panel 102, a rear panel 104, a retaining member 106, and a top wall 108. The first component, the front panel 102, includes an upper edge 110, a lower edge 112, and a forward hinge 114. In this embodiment, the upper edge 110 projects slightly upward from the front panel 102. The lower edge 112 of the front panel is then joined to the forward hinge 114. The forward hinge 114 biases the front panel 102 in a rearward direction toward the rear panel 104. Also, the forward hinge 114 permits the front panel 102 to swing in a forward direction.

The second component, the rear panel 104, includes a top edge 116, a bottom edge 118 and a bent portion 119 disposed therebetween. In this embodiment, the lower edge 112, the forward hinge 114, and the bottom edge 118 of the rear panel 104 are joined together in this order. In the case of a one piece plastic extrusion (or molding) the lower edge 112, the forward hinge 114, and the bottom edge 118 are formed together in a seamless manner. Between the front panel 102 and rear panel 104 a cavity 120 is defined, that is intended to receive an associated label. The front panel 102 is joined to the rear panel 104 such that the front panel 102 is angled slightly inward toward the rear panel 104. This results in the base of the cavity 120 being wider than the upper portion of the cavity 120. In this embodiment, the angular tilt of the front panel 102 will be sufficient to cause the upper edge 110 of the front panel 102 to contact the rear panel 104. This line of contact along the upper edge 110 of the front panel 102 acts to clip the associated label placed therein against the rear panel 104 thereby preventing the label from sliding out from either end of the label holder 100.

The third component, the retaining member 106, includes a lower support flange 122, a rearward hinge 124, and an upper support flange 126. The lower support flange 122 is joined to the rear panel 104 at a location between the top 116 and bottom edge 118 thereof. In this embodiment, the lower support flange 122 projects in a rearward direction and includes an angled portion 128, a medium radius bend 130, and a substantially horizontal portion 132. The horizontal portion 132 of the lower support flange 122 is attached to the rearward hinge 124. The rearward hinge 124 is further attached to the upper support flange 126. From the rearward hinge 124 the upper support flange projects in a forward direction with a downward sloping portion 134, which is connected to a substantially horizontal portion 136, and terminates with a semi-circular, C-shaped, rearward facing free end 138. In this embodiment, the retaining member 106 is formed of semi-rigid plastic and is capable of being deformed to allow the lower support flange 122 to flex downward, the rearward hinge 124 to open in a clockwise direction, and the upper support flange 126 to deflect in an upward and rearward fashion. Furthermore, the bend 130 provides for additional relative vertical flexure between the lower support 122 flange and the rear panel 104. As stated above, the individual components of the retaining member 106 may be joined in a seamless fashion, as in the case of a one piece extrusion or molding.

Lastly the fourth component, the top wall 108, includes a front lip 140 and a rear lip 142. The top wall 108 is attached lengthwise to the top edge 116 of the rear panel 104. In the embodiments shown in FIGS. 1-9, the top wall 108 is oriented substantially parallel to the lower support flange 122, following along a horizontal axis H. The top wall 108 is attached to the top edge 116 of the rear panel 104 at a location between the front lip 140 and the rear lip 142. Also, the front lip 140 is shown shorter in relative length as compared to the rear lip 142. Furthermore, an acute angle $\alpha$ is formed between the horizontal axis H of the top wall 108 and a longitudinal axis L of the rear panel 104. The acute angle $\alpha$ offset prevents the front lip from protruding above the horizontal plane defined by a shelf portion 12 of the merchandise display shelf 10 and from interfering with the stocking and removal of merchandise. Both the front lip 140 and rear lip 142 serve an important purpose. The front lip 140 prevents the front panel 102 from accidentally being drawn forward, which may result in the label becoming dislodged. An example of this would be in the situation where a customer is retrieving merchandise from the display. If in the process of doing so the customer drags the merchandise along the shelf 10 and over the forward end of the shelf 10 where the label holder 100 is attached, the merchandise may catch the upper edge 110 of the front panel 102 and cause the front panel 102 to flex in a forward direction. This may cause the undesirable result of drawing the label out of the label holder 100.

Figure 4:
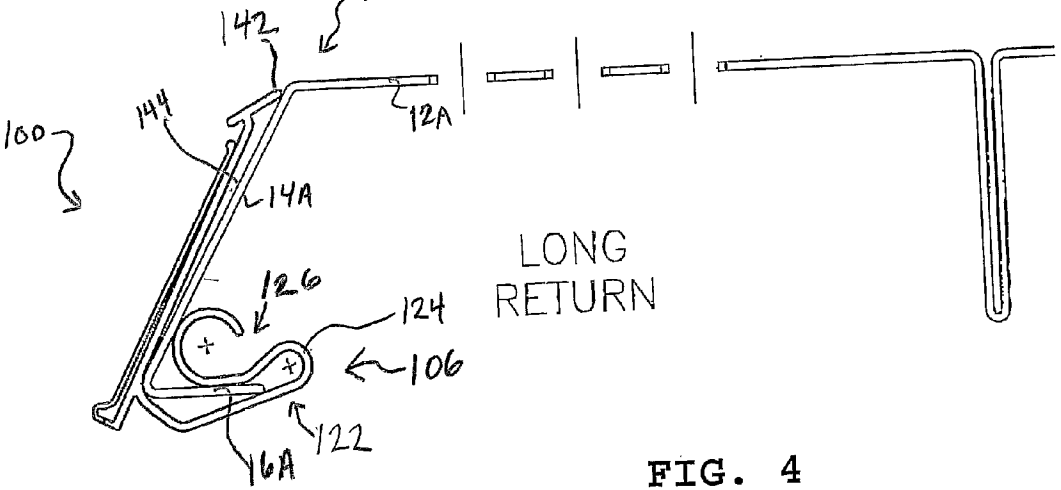
FIG. 4 is a side view of the label holder of FIG. 1 installed on a shelf with a long return (i.e. a longer ledge portion of a shelf).

The rear lip 142 serves an equally important purpose. The rear lip 142 has the primary purpose of generating a moment (or torque) about the points where the retaining member 106 contacts (or grips) the shelf. Opposing reaction forces created by the moment generate greater gripping forces at the rear lip 142 and within the retaining member 106. The rear lip 142 generates this moment when the label holder 100 is mounted onto the shelf 10. As shown in FIGS. 3 and 4, the shelf 10 generally includes the shelf portion 12, an angled forward portion 14, and a ledge portion 16. As the label holder 100 is placed about the forward end of the shelf 10, the rear lip 142 comes into contact with the angled forward portion 14 of the shelf 10 and produces a stress throughout the rear panel 104 placing the rear panel 104 in forwardly canted orientation. To create this stress the rear lip 142 must extend in a rearward direction beyond a plane coincident with that of the rear panel 104. If the rear lip 142 does not extend beyond this plane the rear panel 104 would lie substantially parallel to and against the angled forward portion 14 when mounted. Furthermore, the stress throughout the rear panel 104 would be reduced as well as the gripping forces within the retaining member 106. As a result of the rear lip 142 spacing the rear panel 104 away from an upper end of the angled forward portion 14, a cavity 144 is formed.

With reference to FIG. 3, the label holder 100 is shown as installed on a merchandise display shelf 10. The angled forward portion 14 projects in a forward and downward direction from the shelf portion 12 and the ledge portion 16 projects horizontally rearward from the angled forward portion 14. The angled forward portion 14 and the ledge portion 16 provide the mounting surfaces for the label holder 100. In this embodiment, the label holder 100 is securely mounted to the shelf 10 by pressure exerted by the label holder 100 at five points of contact with the shelf. A first point of contact A is between the rear lip 142 of the top wall 108 and the forward surface of the angled forward portion 14 adjacent its top edge. A second point of contact B is between the label holder 100 and the angled forward portion 14, adjacent its bottom edge. A third point of contact C is between the lower support flange 122 of the retaining member 106 and the rearward edge of the ledge portion 16. A fourth point of contact D is between the upper support flange 126 of the retaining member 106 and the upper surface of the ledge portion 16. A fifth point of contact E is between the upper support flange 126 and the rear surface of the angled forward portion 14.

The rear lip 142 causes the rear panel to flex downward adjacent its upper end. This has two benefits. First, it causes the upper end of the front panel 102 to tightly contact the rear panel 104, thereby trapping a label between the panels. Thus, the label is less likely to become detached from the label holder 100. Second, the flexing of the rear panel 104 causes the retaining member or clip 106 to more closely contact both the ledge portion 16 and the rear side of the angled forward portion 14. In this way, the label holder 100 is more securely mounted on the shelf. Put another way, the presence of the rear lip 142 causes the label holder 100 to clamp the angled forward portion 14 from both sides, to promote a sturdy mounting of the label holder 100 to the shelf 10.

FIGS. 3 and 4 illustrate that the label holder 100 conforms to different length ledge portions. FIG. 3 illustrates the label holder 100 mounted on a shelf 10 with a shorter ledge portion 16 or a "Short Return." FIG. 4 illustrates the label holder 100 mounted on a shelf 10*a* with a shelf portion 12*a* and an angled forward portion 14*a* similar to the shelf portion 12 and the angled forward portion 14 as shown in FIG. 3. However, the shelf 10*a* shown in FIG. 4 has a longer ledge portion 16*a* or a "Long Return." In order to accommodate a longer ledge portion 16*a* of a shelf 10*a*, the lower support flange 122 of the retaining member 106 deflects downward, the rearward hinge 124 opens clockwise, and the upper support flange 126 deflects upward. Conversely, in order to accommodate a shorter ledge portion of a shelf, the lower support flange 122 retracts upward, the rearward hinge 124 closes counter-clockwise, and the upper support flange 126 retracts downward.

Figure 5:
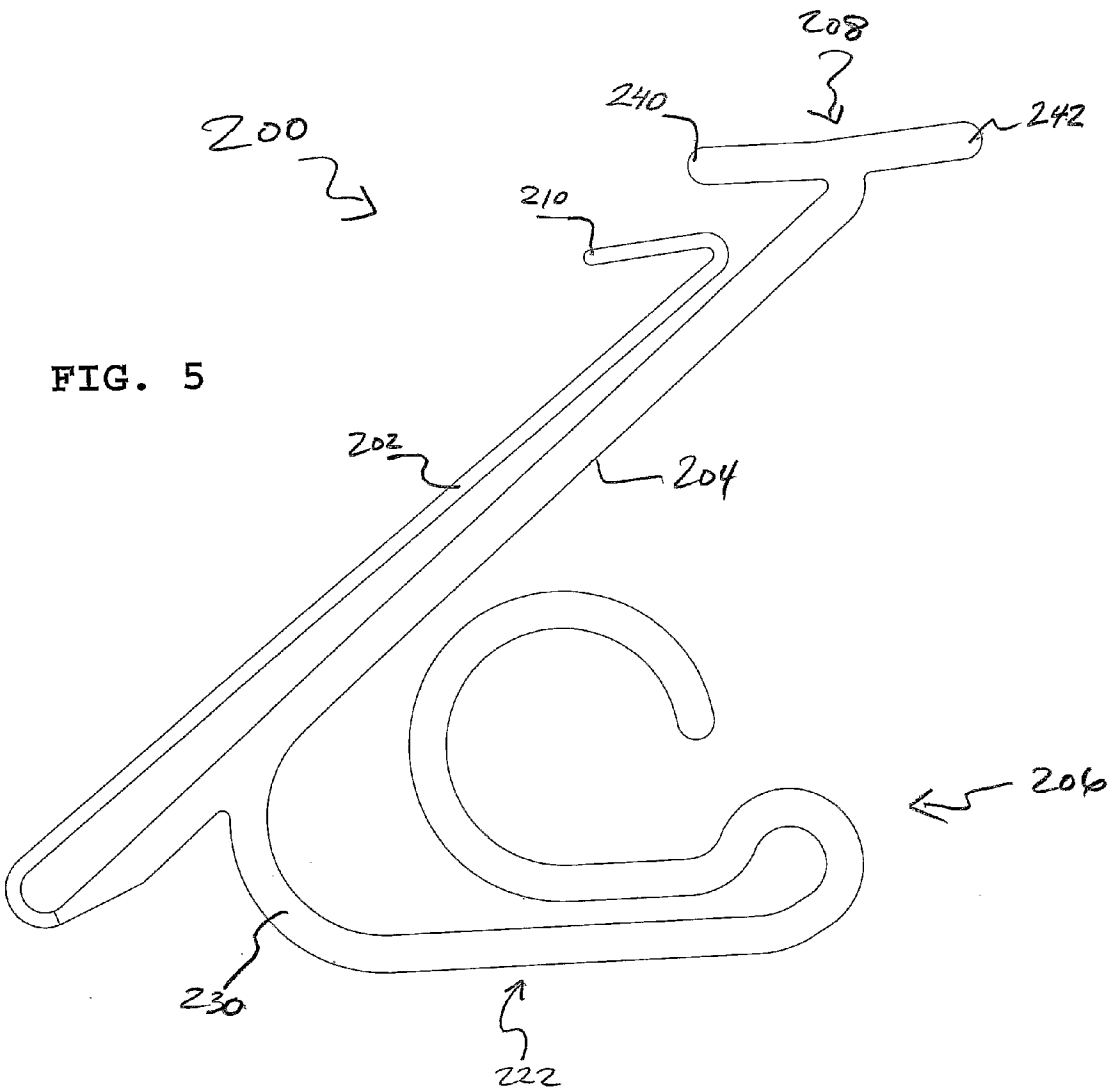
FIG. 5 is a side view of a second embodiment of a label holder according to the present invention illustrating a rolled front panel upper edge, a substantially thicker rear panel, and a substantially horizontal lower support flange.

With reference to FIG. 5, a second embodiment of a label holder 200 is shown. The label holder 200 is similar in design to the previously described embodiment. However, the second embodiment of the label holder 200 departs from the previous embodiment in three respects. First, a front panel 202 includes a rolled upper edge 210. The upper edge 210 of the front panel 202 is angled in a forward and downward direction. The purpose of having the rolled upper edge 210 is to provide a gripping surface that the user (store clerk, stock room attendant, etc.) may grasp in order to pull the front panel 202 forward and access, insert, or remove the label. Second, a top wall 208, a rear panel 204, and a retaining member 206 of the label holder 200 each have a mean thickness greater than that of the front panel 202. As stated previously, the top wall 208, the rear panel 204, and the retaining member 206 cooperate to generate the clamping force required to securely attach the label holder 200 to the shelf 10. Increasing the thickness of these components increases the force required to deflect each component. The higher forces therefore generate higher contact pressures at the five points of contact discussed previously. Third, at the location where a lower support flange 222 of the retaining member 206 is attached to the rear panel 204, the lower support flange 222 immediately bends about a radius 230 rather than projecting nearly perpendicularly as in the embodiment shown in FIG. 2. The immediate bend 230 of this embodiment has the effect of creating a shorter lower support flange 222 which facilitates installation on shorter ledge portion type display shelves as well as generating higher contact pressures within the retaining member 206.

Figure 6:
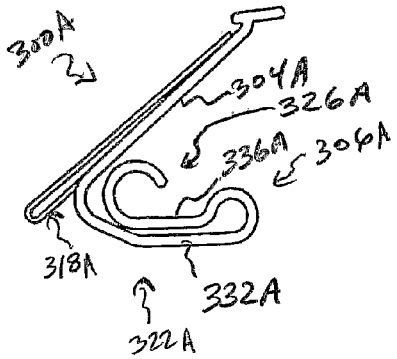
FIG. 6 is a side view of a third embodiment of a label holder according to the present invention illustrating an upper and lower support flange having longer horizontal portions and a rear panel having a thinner bottom edge.

With reference to FIG. 6, a third embodiment of a label holder 300*a* is shown. In this embodiment, a straight or horizontal portion 332*a*, 336*a* of a lower and an upper support flange 322*a*, 326*a* of a retaining member 306*a* have been elongated to provide for the longer ledge portion 16*a* of the shelf 10*a* as shown in FIG. 4. Furthermore, the straight portions 332*a*, 336*a* provide substantial and uniform contact with the respective upper and lower surfaces of the ledge portion of the display shelf. This increases the overall grip of the label holder to the shelf. In addition, a bottom edge portion 318*a* of a rear panel 304*a* is substantially thinner than the remaining portion of the rear panel 304*a*. Since the portion of the rear panel 304*a* below the retaining member 306*a* is subject to less stress while the label holder 300*a* is installed, less material is needed in this portion of the label holder 300*a* thereby lowering production costs.

Figure 7:
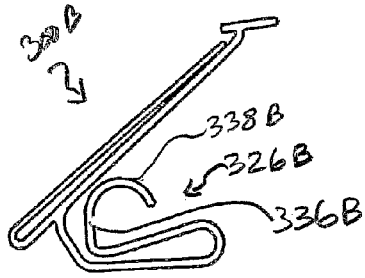
FIG. 7 is a side view of a fourth embodiment of a label holder according to the present invention illustrating a modified design of the upper and lower support flanges.

With reference to FIG. 7, a fourth embodiment of a label holder 300*b* is shown. In this embodiment, an upper support flange 326*b* has a sharp vertical bend near the midpoint followed by a straight vertical portion 336*b* and terminating in a curved rearward facing end portion 338*b*. This geometry lends itself to various other ledge portion shelf designs.

Figure 8:
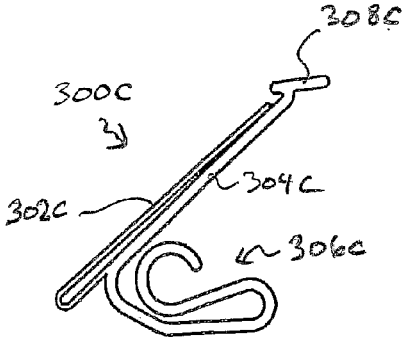
FIG. 8 is a side view of a fifth embodiment of a label holder according to the present invention, which is similar to the embodiment shown in FIG. 6, except that the horizontal portion of the upper support flange has been omitted.
Figure 9:
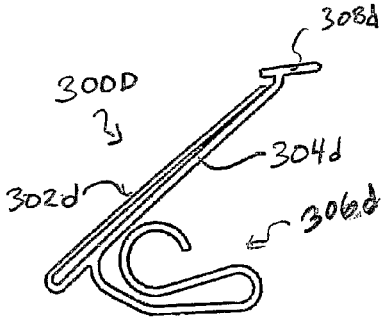
FIG. 9 is a side view of a sixth embodiment of a label holder according to the present invention, illustrating selectively thicker portions of the embodiment shown in FIG. 8.

With reference to FIGS. 8 and 9, a fifth embodiment 300*c* and a sixth embodiment 300*d* are shown. These two embodiments 300*c*, 300*d* are identical to one another in overall geometry and differ only in the thickness of the material allocated to a front panel 302*c*, a rear panel 304*c*, a top wall 308*c*, and the retaining member 306*c*. The remaining features of the embodiments shown in FIGS. 8 and 9 represent a combination of features of previously described embodiments.

Figure 10:
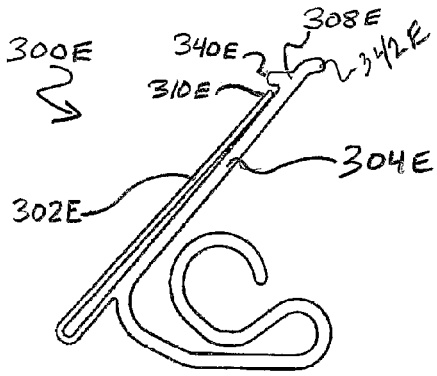
FIG. 10 is a side view of a seventh embodiment of a label holder according to the present invention illustrating a modified top wall.

With reference to FIG. 10, a seventh embodiment of the label holder 300*e* is shown. This embodiment 300*e* reflects a modification in a top wall 308*e*. In previous embodiments the top wall was substantially flat. Here, the top wall 308*e* has protrusions extending at different heights from a rear panel 304*e*. A front lip 340*e* of the top wall 308*e* projects in a forward direction from the rear panel 304*e*. A rear lip 342*e* projects upward and rearward from the rear panel 304*e*. Locating the front lip 340*e* on a lower horizontal axis from that of the rear lip 342*e* allows for the front panel 302*e* to be shorter (thereby accommodating smaller labels for a shelf having a similar angled forward portion 14) without forfeiting the benefit of having the front lip 340*e* located directly above the upper edge 310*e* of the front panel 302*e*. In other words, providing a shorter front panel 302*e* and maintaining the same location of the front lip 340*e* would leave a large gap between the upper edge of the front panel and the front lip. This additional gap could allow the label to shift upwards. By lowering the front lip 340*e* and minimizing the gap, the label is properly maintained in the correct position.

Figure 11:
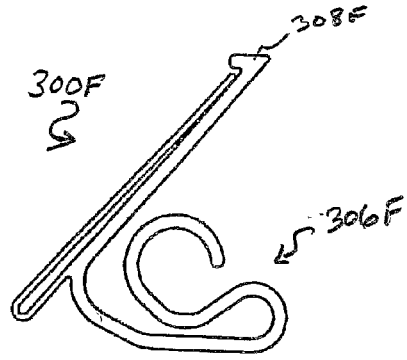
FIG. 11 is a side view of an eighth embodiment of a label holder according to the present invention, illustrating a top wall with only a front lip and the absence of a rear lip.

With reference to FIG. 11, an eighth embodiment of a label holder 300*f* is shown. In this embodiment a rear lip of the top wall 308*f* has been eliminated. By eliminating the rear lip, less moment is generated about a retaining member 306*f*, and a more traditional style of the label holder is depicted.

Figure 12:
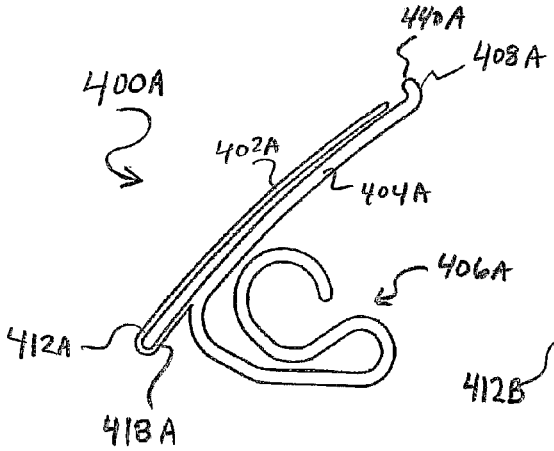
FIG. 12 is a side view of a ninth embodiment of a label holder according to the present invention illustrating curved front and rear panels.

With reference to FIG. 12, a ninth embodiment of a label holder 400*a* is shown. With the exception of FIGS. 15 and 20, the remaining embodiments and the present embodiment 400*a* include a curved front panel 402*a* and a curved rear panel 404*a*. In addition, with respect to the top wall 408*a*, all of the remaining embodiments include only a forward projecting front lip 440*a* (and no rear lip). Without a rear lip to bias the rear panel 404*a* in a forward direction, less moment and contact pressure are generated within the retaining member 406*a*. However, in these embodiments, the curved front and rear panels 402, 404 will deflect to some degree when contacting a planar angled forward portion of a shelf and generate additional moment about the retaining member 406 upon installation of the label holder 400. In contrast to using a rear lip, using curved front and rear panels 402, 404 maybe a less preferable method of generating the desired moment to provide the clamping force. It could be argued that a more rigid and substantially flat rear panel with a rear lip generates more moment and concentrates the force created by the moment more efficiently into the retaining member.

Figure 13:
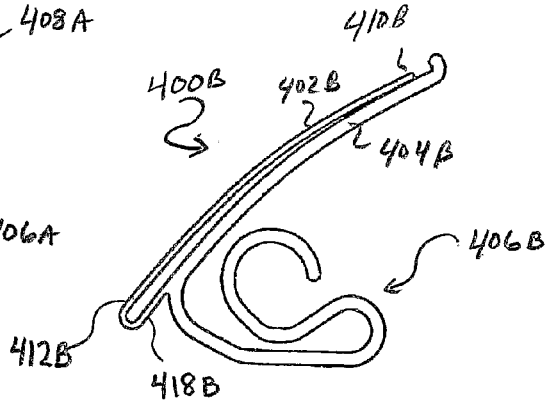
FIG. 13 is a side view of a tenth embodiment of a label holder according to the present invention, in which the upper edge of the curved front panel is in contact with the curved rear panel.

With reference to FIG. 13, a tenth embodiment 400*b* is shown that is nearly identical to the ninth embodiment 400*a* shown in FIG. 12. In the tenth embodiment 400*b*, an upper edge 410*b* of a front panel 402*b* actually contacts a rear panel 404*b* whereas in the ninth embodiment the front panel 402*a* does not contact the rear panel 404*a*. Depending on the thickness of the labels intended to be used with the label holder 400 it maybe desirable to use one embodiment over the other. In addition, a lower edge 412*b* and a bottom edge 418*b* are slightly shorter than the lower and bottom edges 412*a*, 418*a* of the ninth embodiment as shown in FIG. 12.

With reference to FIGS. 14 through 18, further embodiments of the label holder 400*c-g* are shown that share a common edge 444*c-g*. The common edge 444*c-g* of these embodiments 400*c-g* depict a label holder having a common location where a lower edge 412*c-g* and a forward hinge 414*c-g* of a front panel 402*c-g*, a bottom edge 418*c-g* of a rear panel 404*c-g*, and a retaining member 406*c-g* all join together. Combining multiple surfaces and edges not only provides a label holder 400 that can accommodate different shelf designs but also may facilitate the production process by eliminating unnecessary features in a die or mold. Now with reference to FIGS. 14 through 17, the retaining member 406*c-f* still includes a lower support flange 422*c-f*, a rearward hinge 424*c-f*, and an upper support flange 426*c-f* as described above with reference to FIGS. 1 through 4. However, the lower support flange 422*c-f* has a sharper bend and the upper support flange 426*c-f* no longer includes the downward sloping portion (134 in FIG. 1). In addition, the rearward hinge 424*c-f* has a smaller radius that is approximately equal to half the mean distance between the horizontal portion 432*c-f* of the lower support flange 422*c-f* and a horizontal portion 436*c-f* of the upper support flange 426*c-f*.

Figure 14:
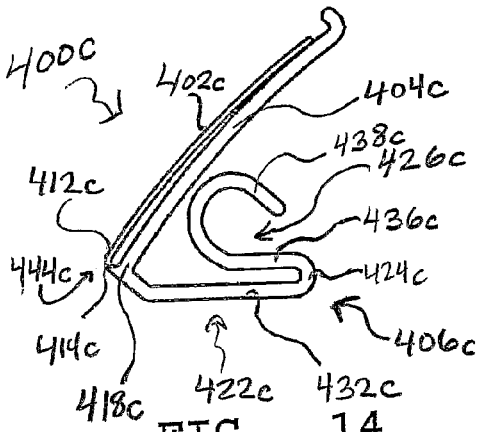
FIG. 14 is a side view of an eleventh embodiment of a label holder according to the present invention wherein the front panel, rear panel, and retaining member join together at a common edge.
Figure 15:
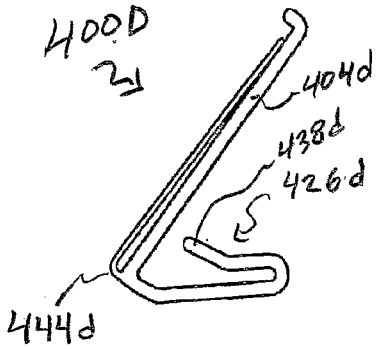
FIG. 15 is a side view of a twelfth embodiment of a label holder according to the present invention illustrating a straight back panel.

With reference to FIG. 15, a twelfth embodiment of the label holder 400*d* is shown. As stated previously, the embodiment of FIG. 15 does not share the same curved front and rear panel design as first described above with reference to FIG. 12. However, this embodiment does share the common edge 444*d* feature as described with reference to FIG. 14. Specifically, the embodiment of FIG. 15 differs from the other embodiments in that the upper support flange 426*d* does not form the typical semi-circular rearward facing free end 138 (FIG. 1) as described in previous embodiments. Rather, an upper support flange 426*d* of this embodiment terminates in a forward facing free end 438*d* that is nearly perpendicular to the rear panel 404*d*.

Figure 16:
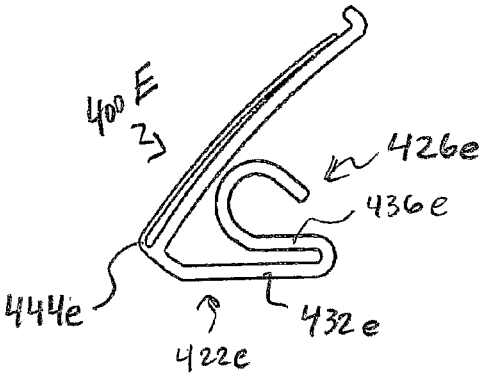
FIG. 16 is a side view of a thirteenth embodiment of a label holder according to the present invention illustrating shorter horizontal portions of the upper and lower support flanges than the embodiment of FIG. 14.

With reference to FIG. 16, a thirteenth embodiment of a label holder 400*e* is shown. The thirteenth embodiment is nearly identical to the eleventh embodiment 400*c* as shown in FIG. 14. The only difference is that the horizontal portions 432*e*, 436*e* of the lower and upper support flanges 422*e*, 426*e* of the thirteenth embodiment are shorter than those shown in the eleventh embodiment. The horizontal portions 432*e*, 436*e* are shorter in order to accommodate a shelf design with a shorter ledge portion (16 as shown in FIG. 3).

Figure 17:
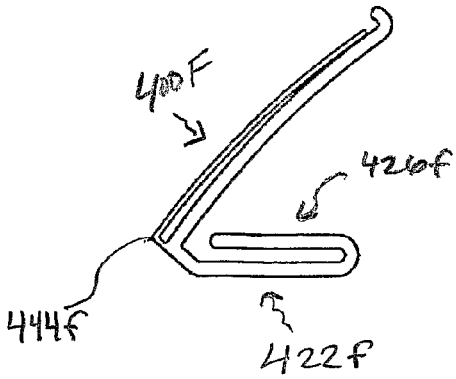
FIG. 17 is a side view of a fourteenth embodiment of a label holder according to the present invention, illustrating a substantially horizontal upper support flange.

With reference to FIG. 17, a fourteenth embodiment of the label holder 400*f* is shown. The fourteenth embodiment 400*f* is very similar to the eleventh embodiment 400*c* of FIG. 14 except that an upper support flange 426*f* shown in FIG. 17 lacks the semi-circular rearward facing free end 438*c*. The upper support flange 426*f* shown in FIG. 17 is substantially horizontal and parallel to the lower support flange 422*f*.

Figure 18:
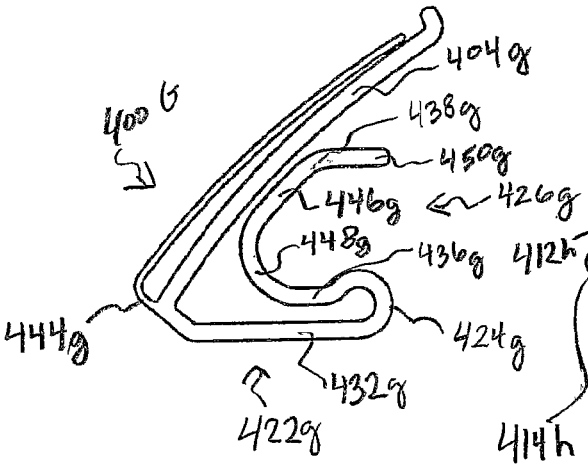
FIG. 18 is a side view of a fifteenth embodiment of a label holder according to the present invention, illustrating a longer upper support flange having a straight portion that is substantially parallel to the rear panel and a horizontally rearward terminating end.

With reference to FIG. 18, a fifteenth embodiment of a label holder 400*g* is shown. The fifteenth embodiment 400*g* is similar to the eleventh embodiment 400*c* except that an upper support flange 426*g* and a rearward hinge 424*g* are significantly modified. Within a semi-circular rearward facing free end 438*g* a straight portion 446*g* is disposed between an upward curving portion 448*g* and a horizontally rearward terminating end 450*g*. The straight portion 446*g* is substantially parallel to a rear panel 404*g*. In addition, the rearward hinge 424*g* shown in FIG. 18 has a larger radius such that the diameter of the rearward hinge 424*g* is larger than the vertical distance between the horizontal portion 432*g* of the lower support flange 422*g* and the horizontal portion 436*g* of the upper support flange 426*g*.

Figure 19:
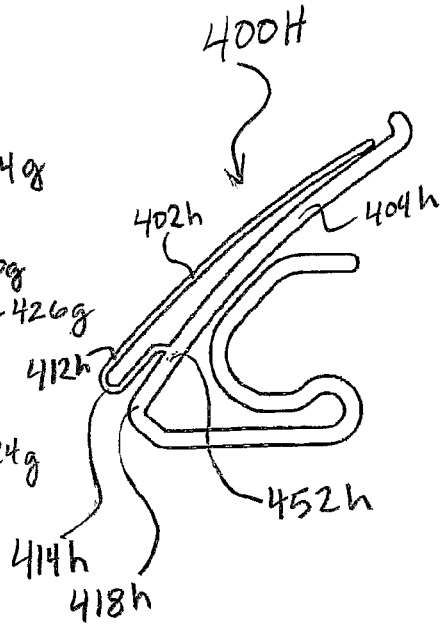
FIG. 19 is a side view of a sixteenth embodiment of a label holder according to the present invention, illustrating the lower edge and the forward hinge of the front panel being attached at a point above the bottom edge of the rear panel.

With reference to FIG. 19, a sixteenth embodiment of a label holder 400*h* is shown. The sixteenth embodiment 400*h* is similar to the fifteenth embodiment 400*g* except that a lower edge 412*h* and a forward hinge 414*h* of a front panel 402*h* are not attached to a common edge 444*c* as discussed previously with reference to the eleventh embodiment 400*c*. Rather, a forward hinge 414*h* of the front panel 402*h* is attached to a rear panel 404*h* at a location 452*h* above a bottom edge 418*h* of the rear panel 404*h*. In all other respects the sixteenth embodiment 400*h* is identical to the fifteenth embodiment 400*g*.

Figure 20:
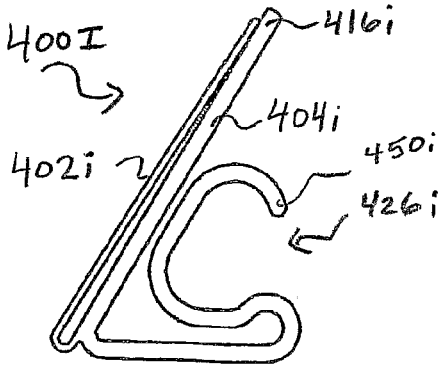
FIG. 20 is a side view of a seventeenth embodiment of a label holder according to the present invention, illustrating a flat front panel and rear panel and a longer upper support flange having a straight portion that is substantially parallel to the rear panel and a downward curving end.

With reference to FIG. 20, a seventeenth embodiment of a label holder 400*i* is shown. The seventeenth embodiment 400*i* does not have the curved front and rear panels as described previously. Rather, a front panel 402*i* and a rear panel 404*i* are flat. In addition, the seventeenth embodiment 400*i* has neither a top wall nor any front or rear lips projecting from a top edge 416*i* of the rear panel 404*i*. An upper support flange 426*i* is similar to the upper support flange 426*g* shown in FIG. 18 with the exception that the upper support flange 426*i* of the seventeenth embodiment terminates in a downward curving end 450*i* rather than the horizontally rearward terminating end 450*g* show in FIG. 18.

Figure 21:
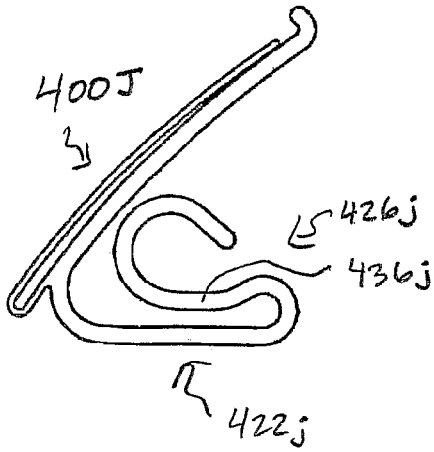
FIG. 21 is a side view of an eighteenth embodiment of a label holder according to the present invention, illustrating a substantially horizontal lower support flange.

Lastly, with reference to FIG. 21, an eighteenth embodiment of a label holder 400*j* is shown that is similar to the tenth embodiment 400*b* shown in FIG. 13. The eighteenth embodiment differs in that an upper support flange 426*j* has a longer horizontal portion 436*j* and a lower support flange 422*j* is substantially horizontal.

The present invention relates to a one piece label holder having a novel improvement for increasing the gripping strength of the label holder to the display shelf. The associated merchandise display shelf has a shelf portion, an angled forward portion, and a ledge portion. The shelf portion is typically a horizontal planar surface where merchandise is stored. The angled forward portion is attached along the forward end of the shelf portion and is angled downward and forward. Attached to a bottom edge of the angled forward portion is a rearward projecting ledge portion. The ledge portion provides the primary surface by which the label holder is selectively mounted to the display shelf.

In one embodiment, the label holder includes a front panel, a rear panel, a retaining member, and a top wall. The front panel has an upper edge and a lower edge. The rear panel has a top edge and a bottom edge. The lower edge of the front panel is attached to one end of a forward hinge. The other end of the forward hinge is then attached along the front surface of the rear panel. In this embodiment, the hinge is attached to the bottom edge of the rear panel. Between the front and rear panel a cavity is defined and is intended to receive an associated label. The forward hinge is resilient such that it biases the front panel in a rearward direction against the rear panel. However, the forward hinge also permits the front panel to be pulled in a forward direction to allow the insertion or removal of a label. The retaining member is attached on the rear surface of the rear panel. The retaining member includes a lower support flange, a rearward hinge, and an upper support flange. The retaining member engages the ledge portion of the shelf in a cavity between the upper and lower support flanges when the label holder is installed. Due to the deflection of the upper and lower support flanges pressure is generated at the contact points between the label holder and the shelf. As a result of the pressure generated, the retaining member is able to securely support the label holder.

In this embodiment, a top wall is attached along a top edge of the rear panel, it includes a front lip and rear lip. The rear lip engages the angled forward portion of the shelf causing the rear panel to be biased in a forward direction. The biasing of the rear panel exerts an additional moment or force within the retaining member which generates greater contact pressure between the retaining member and the shelf. This increased contact pressure securely and reliably maintains the label holder on the merchandise display shelf.

Several exemplary embodiments have thus been described. Modifications and alterations may occur to others upon reading and understanding the preceding detailed description. It is intended that the exemplary embodiments be construed as including all such modifications and alterations insofar as they come within the scope of the appended claims or the equivalents thereof.

The invention claimed is:

1. A label holder selectively mounted to an associated merchandise display shelf, comprising:

a front panel;

a rear panel;

a hinge connecting said front panel to said rear panel;

a retaining member projecting rearwardly from said rear panel for selectively engaging a ledge portion of the associated shelf, said retaining member comprising a first planar section and a second planar section connected to, overlying and spaced from said first section, and extending parallel thereto forming a gap therebetween; and, a lip projecting rearwardly from said rear panel in a spaced manner from said retaining member, said rear panel assuming a substantially flat orientation when not mounted on the associated shelf and wherein said lip engages an angled forward portion of the associated shelf when the label holder is in a mounted condition and said rear panel assumes a forwardly canted orientation.

2. The label holder of claim 1, wherein a mean thickness of said rear panel is greater than a mean thickness of said front panel.

3. The label holder of claim 1, wherein an upper edge of said front panel projects forwardly.

4. The label holder of claim 1 wherein a cavity is defined between said front panel and said rear panel for receiving an associated label.

5. A one piece label holder selectively mounted to an associated merchandise display shelf, the display shelf comprising a shelf portion attached to an angled forward portion, and a ledge portion, the label holder comprising: a front panel, including an upper edge and a lower edge; a rear panel, including an upper edge and a lower edge; a panel hinge connecting said front panel to said rear panel, creating a cavity between said front panel and said rear panel for receiving an associated label; a retaining member projecting rearwardly from said rear panel, the retaining member including a lower support flange, an upper support flange, and a hinge connecting said lower support flange to said upper support flange, said lower support flange configured to contact a lower surface of the ledge portion of the associated merchandise display shelf and said upper support flange configured to contact an upper surface of the ledge portion of the associated merchandise display shelf when said label holder is in an installed position; and a top wall mounted to said upper edge of said rear panel, including a portion protruding rearwardly from said rear panel, said rear panel assuming a substantially flat orientation when not mounted on the associated shelf and wherein said portion engages an angled forward portion of the associated shelf when the label holder is in a mounted condition and said rear panel assumes a forwardly canted orientation.

6. The label holder of claim 5, wherein said lower support flange includes a bend allowing for relative vertical flexure between said lower support flange and said rear panel.

7. The label holder of claim 5, wherein said hinge of said retaining member includes a uniform radius bend from a first location where said hinge of said retaining member connects to said lower support flange to a second location where said hinge of said retaining member connects to said upper support flange.

8. The label holder of claim 5, wherein said upper support flange includes a straight portion for substantially uniform contact with the upper surface of the ledge portion of the associated display shelf when said label holder is in said installed position.

9. The label holder of claim 5, wherein said lower support flange includes a straight portion for substantially uniform contact with the lower surface of the ledge portion of the associated display shelf when said label holder is in said installed position.

10. The label holder of claim 5, wherein a mean thickness of said rear panel is greater than a mean thickness of said front panel.

11. The label holder of claim 5, wherein said lower edge of said front panel, said lower edge of said rear panel, and said retaining member are joined together along a common edge.

12. The label holder of claim 5 wherein said top wall further comprises a forwardly extending portion which protrudes forwardly of said rear panel.

13. The label holder of claim 12 wherein said forwardly extending portion is shorter than said rearwardly extending portion of said top wall.

14. The label holder of claim 5 wherein said top wall is oriented at an acute angle to a longitudinal axis of said rear panel.

15. The label holder of claim 5 wherein said rear panel comprises a bent portion located adjacent said upper edge thereof.

16. The label holder of claim 5 wherein said rear panel is longer than said front panel so that a forwardly extending portion of said top wall overlies said front panel.

17. The label holder of claim 5 wherein said retaining member accommodates ledges of varying lengths of the associated display shelf such that said lower support flange adopts a first orientation in relation to a shorter ledge portion of the associated display shelf and a second orientation in relation to a longer ledge portion of the associated display shelf.

18. The label holder of claim 5 wherein an upper end portion of said front panel contacts an upper end portion of said rear panel even when the label holder is not mounted to the associated display shelf.

19. The label holder of claim 1, wherein when said lip engages the angled forward portion of the associated shelf, said rear panel assumes said forwardly canted orientation pivoting the retaining member and generating an increased clamping pressure between the retaining member and the ledge potion of the associated display shelf when said label holder is in said mounted condition.

20. A label holder selectively mounted to an associated merchandise display shelf, comprising:

a front panel;

a rear panel;

a hinge connecting said front panel to said rear panel, creating a pocket between said front panel and said rear panel for receiving an associated label;

a retaining member projecting rearwardly from said rear panel and configured to engage a ledge portion of the associated display shelf, said retaining member comprising a first planar section and, a second planar section connected to, overlying and spaced from said first section, and extending parallel thereto forming a gap therebetween, a first lip extending rearwardly from an upper portion of said rear panel; and a second lip extending in a forward direction from said rear panel, said second lip being coplanar with said first lip;

wherein said first lip engages an angled forward portion of the associated display shelf, pivots the retaining member, and generates an increased clamping pressure between the retaining member and the ledge potion of the associated display shelf when said label holder is in an installed position.

21. The label holder of claim 20, wherein a mean thickness of said rear panel is greater than a mean thickness of said front panel.

22. The label holder of claim 20, wherein said front panel and said rear panel are substantially flat when said label holder is in a relaxed position.

23. The label holder of claim 20, wherein an upper portion of said front panel contacts said upper portion of said rear panel when said first lip engages the angled forward portion of the associated display shelf when said label holder is in said installed position.

24. The label holder of claim 20, wherein a cavity is defined between said rear panel and a forward surface of the angled forward portion of the associated display shelf when said label holder is in said installed position.

25. The label holder of claim 20, wherein said retaining member includes a first contact point, a second contact point, and a third contact point, said first, second, and third contact points configured to contact and removably secure said label holder to the ledge portion of the associated merchandise display shelf when said label holder is in said installed position.

* * * * *